US005483759A

United States Patent [19]

Silverman

[11] Patent Number: 5,483,759

[45] Date of Patent: Jan. 16, 1996

[54] FOOTWEAR OR OTHER PRODUCTS

[75] Inventor: Jeffrey N. Silverman, Brentwood, Tenn.

[73] Assignee: Genesco Inc., Nashville, Tenn.

[21] Appl. No.: 189,874

[22] Filed: Feb. 1, 1994

[51] Int. Cl.[6] ..... A43B 23/00; F21L 15/08

[52] U.S. Cl. ..... 36/137; 36/139; 36/1; 362/205; 362/103

[58] Field of Search ..... 36/137, 139, 1; 362/103, 205, 800

[56] References Cited

U.S. PATENT DOCUMENTS

| | | | |
|---|---|---|---|
| D. 324,940 | 3/1992 | Claveria . | |
| D. 336,975 | 7/1993 | Turner et al. . | |
| 2,572,760 | 10/1951 | Rikelman | 36/137 |
| 2,931,893 | 4/1960 | Gonzalez Arias et al. | 36/137 |
| 2,941,315 | 6/1960 | Irving et al. | 36/137 |
| 2,976,622 | 5/1958 | Shearhouse | 36/137 |
| 3,008,038 | 7/1959 | Dickens et al. | 36/137 |
| 3,800,133 | 3/1974 | Duval | 240/6.4 W |
| 3,893,247 | 7/1975 | Dana, III | 36/137 |
| 3,946,505 | 3/1976 | Dana, III | 36/137 |
| 4,014,115 | 3/1977 | Reichert | 36/137 |
| 4,020,572 | 5/1977 | Chiaramonte, Jr. | 36/137 |
| 4,112,601 | 9/1978 | Chiaramonte, Jr. | 36/137 |
| 4,128,861 | 12/1978 | Pelengaris | 36/137 |
| 4,158,922 | 6/1979 | Dana, III | 36/137 |
| 4,324,054 | 4/1982 | Rovinsky | 36/137 |
| 4,367,515 | 1/1983 | Beard | 36/103 |
| 4,412,205 | 10/1983 | Von Kemenczky | 36/137 |
| 4,588,387 | 5/1986 | Swenson | 362/205 |
| 4,748,366 | 5/1988 | Taylor | 36/137 |
| 4,789,922 | 12/1988 | Cheshire | 362/802 |
| 4,845,863 | 7/1989 | Yung-Mao | 36/114 |
| 4,848,009 | 7/1989 | Rodgers | 36/137 |
| 5,033,212 | 7/1991 | Evanyk | 36/137 |
| 5,052,131 | 10/1991 | Rondini | 36/137 |
| 5,188,447 | 2/1993 | Chiang et al. | 36/137 |
| 5,235,761 | 8/1993 | Chang | 36/137 |
| 5,303,485 | 4/1994 | Goldston et al. | 36/137 |
| 5,343,190 | 8/1994 | Rodgers | 36/137 |

FOREIGN PATENT DOCUMENTS

| | | | |
|---|---|---|---|
| 1253832 | 5/1989 | Canada . | |
| 0121026 | 10/1984 | European Pat. Off. . | |
| 0335467 | 4/1989 | European Pat. Off. . | |
| 0552882 | 1/1993 | European Pat. Off. . | |
| 2643794 | 9/1990 | France | 36/137 |
| 26088485 | 8/1977 | Germany . | |
| 3343897 | 6/1985 | Germany | 36/137 |
| 8005050 | 4/1982 | Netherlands . | |
| 2263386 | 7/1993 | United Kingdom | 36/137 |

*Primary Examiner*—Jacob K. Ackun
*Assistant Examiner*—Marie Denise Patterson
*Attorney, Agent, or Firm*—Fish & Richardson

[57] ABSTRACT

A shoe or other product adapted to emit light, sound, or other energy or radiation is disclosed. Embodiments of the shoes may contain switches depressed only when subjected to the momentum of or pressure from a moveable object such as a rotating ball. The ball and switches may additionally be encapsulated in a housing with a window visible outside the shoe, permitting wearers and others to view the switching being performed.

5 Claims, 1 Drawing Sheet

FOOTWEAR OR OTHER PRODUCTS

FIELD OF THE INVENTION

This invention relates to products adapted to emit light, sound, or other energy or radiation when in motion and more particularly to footwear so adapted.

BACKGROUND OF THE INVENTION

U.S. Pat. No. 4,848,009 to Rodgers discloses a running shoe in which an external battery is connected, via a mercury switch, to a set of light-emitting diodes (LEDs) positioned about the exterior of the shoe sole. The shoe of the Rodgers patent additionally includes a timing circuit to limit the duration of the illumination. The timing circuit appears designed to counteract some of the detrimental effects of including a mercury switch in or on the shoe; otherwise, according to the Rodgers patent, the shoe may be subject to "loss of battery power if . . . stored in an attitude which would maintain switch closure for an extended period."

European Patent Application No. 83307822.3 of Dana III discusses another illuminated running shoe using an external push button switch to connect LEDs or other sources of light to a power source such as a battery. The Dana III application also discloses including a pressure-actuated switch (instead of or in addition to the push button switch), with the switch positioned within the sole of the shoe under the heel of the wearer. If used, the internal pressure-actuated switch closes when subjected to pressure from the wearer's heel.

Yet another illuminated shoe is illustrated in U.S. Pat. No. 2,572,760 to Rikelman. Included within the shoe of the Rikelman patent is a single lever on which a ball rides. Movement of the ball forces the lever to pivot in either of two directions, switching a lamp on when pivoted in one direction and off when pivoted in the other. To prevent premature loss of battery power, the shoe of the Rikelman patent contains a thumb screw that may be used to pivot and maintain the lever in the "off" position.

European Patent Application No. 89200784.0 of Intermedium B.V., finally, discloses footwear adapted for both optical and acoustical signalling. As with the shoe disclosed in the Dana III application, the footwear of the Intermedium B.V. application includes a pressure-sensitive switch within its heel portion. In use, the weight of the wearer's heel compresses air present in a reservoir within the shoe to close the pressure-sensitive switch, thereby activating a loudspeaker and a set of LEDs. Incorporated herein in their entireties by this reference are each of the Rodgers and Rikelman patents and the Dana III and Intermedium B.V. applications.

SUMMARY OF THE INVENTION

The present invention provides an alternative product, such as a shoe, adapted to emit light, sound, or other energy or radiation. Unlike the shoes disclosed in the patents and applications discussed above, those of the present invention are designed to prevent unintended loss of battery power without incorporating any of an electronic timing circuit, heel-pressure-actuated switch, or manually-operated thumb screw or other holding device. Instead, embodiments of the present invention contain one or more (momentary) switches depressed only when subjected to the momentum of or pressure from a moveable object such as a rotating ball. When the shoe itself is stationary, none of the switches is depressed by the ball irrespective of the shoe's attitude. As a result, the products of the present invention actuate only when in motion.

Shoes consistent with the invention additionally may function as games, particularly for children. By encapsulating the ball and switches in a housing with a window visible outside the sole of the shoe, the present invention permits wearers (and others) not only to view the switching being performed, but also to use the visual information to manipulate the ball into position to depress a particular one or sequence of the multiple switches. In some embodiments, each such switch may comprise a resilient metal strip positioned slightly above a metal base. As the ball travels along the base it rolls over the various strips, causing them to contact the base when subjected to the ball's weight. After being depressed by the ball, the resilient strips return to their normal positions above the base. If desired, some of the switches may be made more difficult to close than others, reducing the likelihood of excessive completion of the associated electric circuits.

By decoupling the switches from the pressure of the wearer's heel, the present invention operates even when the wearer is, for example, sitting or jumping. In many such cases, as long as any horizontal movement of the shoe occurs, that movement will cause the ball to rotate and contact between the switch elements to result. Avoiding use of heel-pressure-actuated switches and a single internal two-position lever also permits the switches to be positioned anywhere within or outside the shoe and at any attitude, rather than limiting their placement to under the wearer's heel. Particularly if visible outside the shoe, the switches (and, if desired, other electronic or electro-mechanical components) may be encapsulated or sealed to protect them from the external environment. Not employing mercury in the switches also reduces the health hazards that might otherwise be present were the switch-containing capsules to crack or break.

In addition to one or more switches of the type described above, at least some embodiments of the present invention include a battery or other suitable power source, multiple light sources (such as LEDs), a pre-programmed integrated circuit, and a speaker or other device adapted to translate information from the integrated circuit into acoustical signals. The light and sound sources are connected in parallel to the battery and the switches positioned so that no more than one is actuated at any particular moment. The exterior soles of shoes of these embodiments may additionally include removable covers or other means to permit access to the interiors of the soles as, for example, to replace batteries or other circuit components located within them. Alternatively, removable foot pads could be employed for accessing the interiors of the soles.

It is therefore an object of the present invention to provide a product adapted to emit light, sound, or other energy or radiation.

It is an additional object of the present invention to provide a product, such as a shoe, that emits either or both of optical and acoustical signals when in motion.

It is a further object of the present invention to provide footwear incorporating at least one switch and actuator positioned within the shoe but visible from outside it.

It is another object of the present invention to provide a moveable object, such as rotating ball, to depress resilient members of switches and thereby complete associated electric circuits.

It is yet another object of the present invention to provide a sole with a cover or a shoe with other means for permitting access to the interior of the shoe when necessary or desired.

Other objects, features, and advantages of the present invention will become apparent with reference to the remainder of the written portion and the drawings of this application.

DETAILED DESCRIPTION

Figure 1:
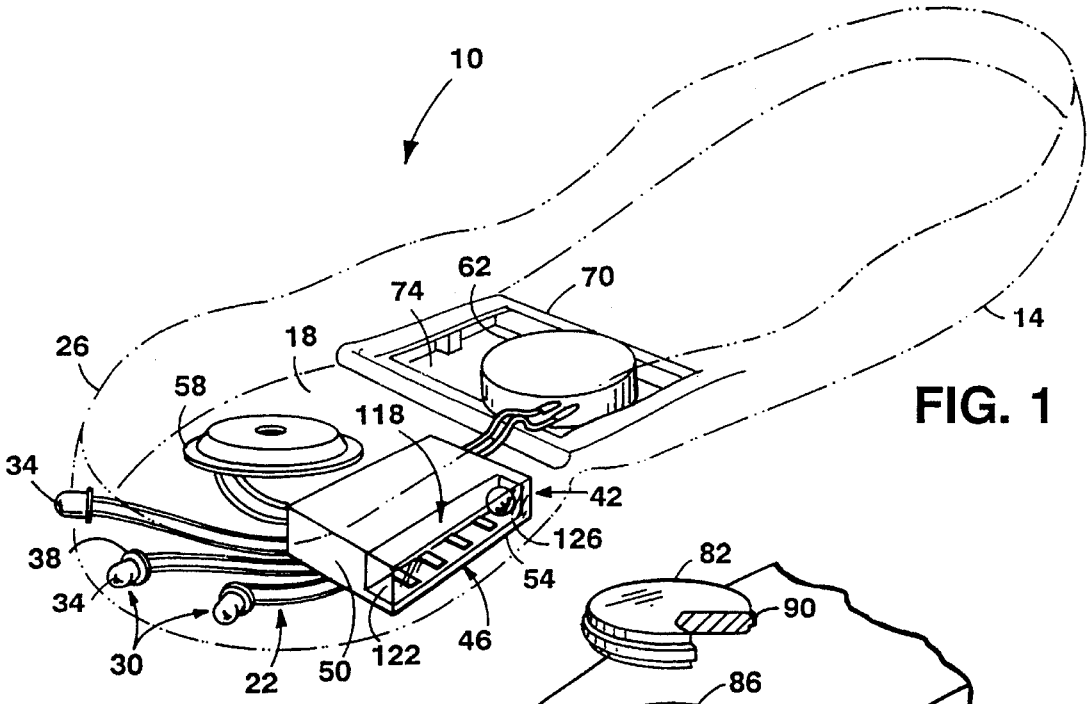
FIG. 1 is a perspective view of the upper, internal portion of the sole of a shoe of the present invention having a cavity into which various components may be inserted.

FIG. 1 illustrates footwear 10 of the present invention. Included as part of footwear 10 is sole 14, shown in FIG. 1 as having a cavity 18 into which circuitry 22 may be placed. Sole 14 may otherwise be identical to molded soles of, for example, conventional athletic shoes, providing an alternative to such soles adapted to emit light, sound, or other energy for aesthetic or utilitarian purposes. Although not shown in FIG. 1, a footpad, an upper, and other components may be attached to sole 14 as needed to manufacture a complete shoe.

Positioned about periphery 26 of sole 14 adjacent the wearer's heel are one or more loads such as light sources 30 of circuitry 22, which may be LEDs or other suitable devices. As shown in FIG. 1, the lenses 34 of light sources 30 may be passed through openings 38 in periphery 26, making them visible externally of footwear 10. Slot 42 may additionally be formed in periphery 26 to make switching elements 46 of circuitry 22 visible outside sole 14. Such switching elements 46 may reside in enclosure 50, which as shown in FIG. 1 has a (clear) window 54 adapted to be positioned and maintained in slot 42 through use of adhesive, a friction fit, or any other suitable means.

Figure 2:
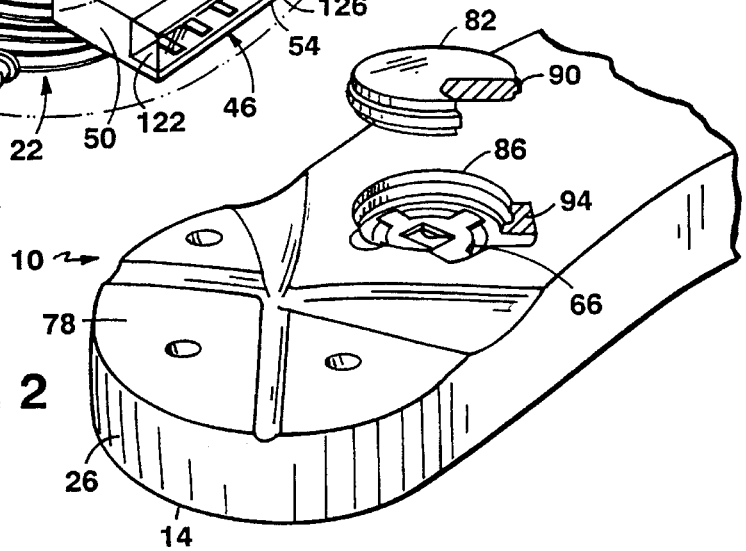
FIG. 2 is a partially-exploded perspective view of part of the lower, external portion of the sole of the shoe of FIG. 1.

Detailed in FIG. 1 are additional portions of circuitry 22, including speaker 58 and compartment 62 for battery 66 (FIG. 2). In some embodiments of footwear 10, cavity 18 may include molded walls 70, defining an area 74 into which compartment 62 may be fitted or adhered. Fixing the position of compartment 62 within cavity 18 facilitates removing and replacing battery 66 when necessary or desired (as when it is depleted). As shown in FIG. 2, the bottom 78 of sole 14 may be equipped with a cover 82 that, when removed, provides access to compartment 62 and battery 66 through aperture 86. Cover 82 may also include ring 90 for engaging seat 94 of aperture 86. Those skilled in the art, however, will recognize that access to battery 66 may be achieved through means other than cover 82 and aperture 86 as, for example, by including a removable foot pad in footwear 10. Moreover, because children (in particular) often outgrow footwear rapidly, battery 66 may outlast the useful life of footwear 10 in many instances and not require replacement or repair.

Figure 3:
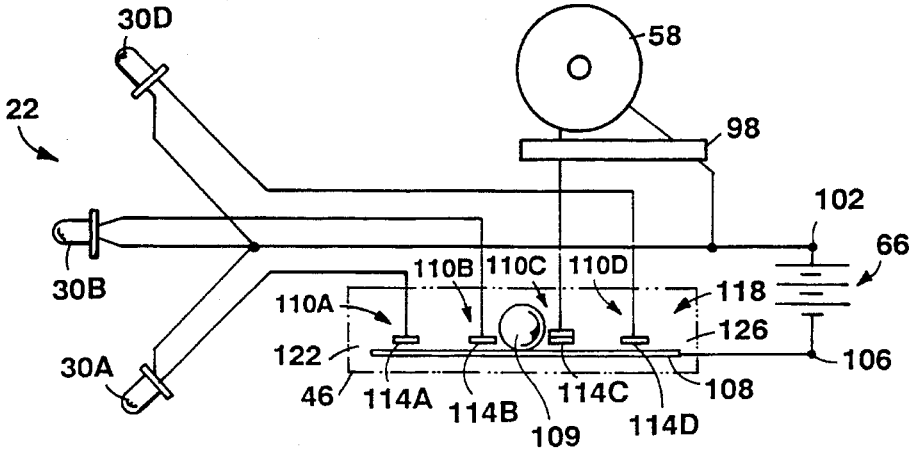
FIG. 3 is a schematic representation of an electro-mechanical circuit associated with the shoe of FIG. 1.

FIG. 3 presents a schematic representation of the (electro-mechanical) circuitry 22 of footwear 10. In addition to light sources 30, switching elements 46, speaker 58, and a power source such as battery 66, circuitry 22 may also comprise integrated circuit 98 or any other suitable means for actuating speaker 58. In at least one embodiment of footwear 10 consistent with FIG. 3, battery 66 is a conventional disc-type device designed to provide three volts at approximately 100–180 milliAmps. In this embodiment one terminal 102 of battery 66 is connected directly to each of three LEDs (30A, 30B, 30D) chosen as light sources 30 and to an input portion of integrated circuit 98. The other terminal 106 of battery 66 is connected via switching elements 46 to light sources 30 and integrated circuit 98. In turn, output portions of integrated circuit 98 are connected to speaker 58.

Switching elements 46 housed within enclosure 50 include electrically-conductive base 108 (such as a metal foil or strip), ball 109, and resilient conducting strips 110A–D. One end of each conducting strip 110A–D is electrically connected to LEDs 30A, 30B, integrated circuit 98, and LED 30D, respectively, while the other (contact) end 114A–D of each respective conducting strip 110A–D is adapted to contact base 108. Base 108, ball 109, and contact ends 114A–D may be positioned within enclosure 50 in race 118, which abuts window 54 to permit viewing of the switching being performed by switching elements 46 when footwear 10 is in use.

As best illustrated in FIG. 3, contact ends 114A–D may be spaced within race 118 and biased to be slightly above (and thus not normally in contact with) base 108. As ball 109 rolls back and forth within race 118, it rolls over contact ends 114A–D and completes the relevant circuits. For example, as ball 109 rolls over contact end 114B, its momentum depresses end 114B into contact with base 108 to illuminate LED 30B. Depressing contact ends 114A and 114D illuminate LEDs 30A and 30D, respectively, while depressing end 114C actuates speaker 58 through integrated circuit 98. The resiliency of contact ends 114A–D causes them to return to their normal positions above base 108 when not subjected to the weight of ball 109. If contact ends 114A–D are spaced greater than the diameter of ball 109 (see, e.g., FIG. 3), no more than one of ends 114A–D may be depressed at any particular moment. Similarly, if the widths of contact ends 114A–D are substantially less than the diameter of ball 109, the ball 109 is unlikely to rest on any end 114A–D for any substantial amount of time.

FIG. 3 also shows contact end 114C higher above base 108 than ends 114A, 114B, and 114D. As a result, more momentum of ball 109 may be required to depress end 114C into contact with base 108 and actuate speaker 58 than to depress ends 114A, 114B, and 114D and illuminate LEDs 30A, 30B, and 30D. In some circumstances this, of course, would necessitate more rapid movement of the wearer and footwear 10 to actuate speaker 58. Such unequal spacing is not required, however, and differing actuation characteristics may be achieved through other means.

If sole 14 rests in a position other than parallel to the floor or ground (e.g. when footwear 10 is thrown onto other items in the bottom of a closet), race 118 will not be horizontal and ball 109 will travel to the lower of race ends 122 and 126. Because contact ends 114A–D are spaced from race ends 122 and 126, none will be depressed in such circumstances and battery 66 will not be prematurely depleted. Making ball 109 of insulating material, moreover, permits it to rest against both base 108 and any of contact ends 114A–D without completing any of circuitry 22. Alternatively, if ball 109 is made of metal (or some other electrical conductor), base 108 may include non-conducting surfaces so that, when ball 109 rests against any of contact ends 114A–D, it also rests over a non-conducting surface of base 108. These designs prevents ball 109 from completing circuitry 22 and depleting battery 66 when footwear 10 is stationary, even when sole 14 is parallel to the floor or ground.

Because switching elements 46 function independently of the pressure exerted on the sole by the wearer's heel, they can operate even when the wearer is sitting or jumping. Almost any horizontal motion of footwear 10 will cause ball 109 to rotate over one or more of contact ends 114A–D. Appropriate back and forth motion of footwear 10, moreover, can cause repeated actuation of LEDs 30A, 30B, 30D, and speaker 58. Although race 118 of FIG. 1 is shown parallel to the bottom 78 of sole 14 near the wearer's heel, the independence of switching elements 46 from heel pressure of the wearer permit them to be positioned anywhere within or outside footwear 10 and at any attitude. Thus, race 118 could be rotated up to ninety degrees and one or more switching elements 46 adapted to actuate when the wearer jumps, for example.

Encapsulating switching elements 46 and other components of circuitry 22 protect them against the external environment, including moisture entering sole 14 from either wet floors or ground or perspiration of the wearer. Making the discrete momentary switching elements visible outside footwear 10 permits the wearer or others to see the position of ball 109 and, if desired, use the visible information to attempt to manipulate ball 109 into particular positions (or sequences of positions). Although either of a pair of left and right footwear 10 may include any number of light sources 30 (including none) positioned anywhere in or on the footwear 10, they typically will both have at least one light source 30 along periphery 26. By contrast, speaker 58 and integrated circuit 98 may be omitted from one of the pair of footwear 10, particularly if integrated circuit 98 is programmed to play a series of notes (e.g. a tune) whenever end 114C is depressed into contact with base 108. Speaker 58 alternatively may be replaced by a buzzer or other sound-generating device connected directly or indirectly to one of switching elements 46.

The foregoing is provided for purposes of illustration, explanation, and description of embodiments of the present invention. Modifications and adaptations to these embodiments will be apparent to those skilled in the art and may be made without departing from the scope and spirit of the invention. In particular, the present invention is not limited to use in connection with footwear, but rather may be included as part of other clothing or incorporated into flying discs, thrown, batted, or kicked balls, various toys, or any other moveable object. Similarly, although conducting strips 110A–D are described as resilient metal strips, they may be springs or any other material adapted to conduct electricity when contacted by ball 109 (or other suitable medium) and not conduct electricity otherwise.

What is claimed is:

1. Footwear, comprising a body having an outer surface, such outer surface having an aperture therein, and an electric circuit at least partially positioned in said aperture, said electric circuit comprising: a switching assembly including a pair of electrical contacts visible through said aperture in said outer surface of said footwear, each of said pair of electrical contacts for switching between an open position and a closed position to open and close said electrical circuit, and a common actuator, comprising a ball, visible through said aperture in said outer surface of said footwear for switching each of said pair of electrical contacts between open position and closed position in response to movement of said footwear and wherein a first one of said pair of electrical contacts further comprises a resilient, electrically-conductive member for moving from said open position toward said closed position when depressed by said ball.

2. Footwear according to claim 1, wherein said electric circuit further comprises (a) a power source, (b) a light source, and (c) a sound source, said light source being connected to said power source via said pair of electrical contacts and said sound source being connected to said power source via a further electrical contact.

3. Footwear according to claim 1, wherein said switching assembly comprises: a ball, and a race for said ball, and wherein a first one of said pair of electrical Contacts comprises an electrically-conductive base of said race and another of said pair of electrical contacts is disposed at rest in said open position, spaced from said base; and wherein said ball is positioned in said race to roll along said base in response to movement of the footwear and depress the first one of said pair of electrical contacts from said open position toward said closed position into electrical contact with said base.

4. Footwear according to claim 3 in which the ball is prevented from depressing the first one of said pair of electrical contacts toward said closed position, into electrical contact with the base, when the footwear is stationary, irrespective of the attitude of the footwear.

5. A shoe comprising:

a. an upper portion;

b. a sole (1) connected to the upper portion, (2) having a bottom surface, (3) having a periphery defining an aperture, a plurality of openings, and a cavity; and c. electric circuitry positioned within the cavity and comprising;

i. a battery;

ii. a plurality of light sources equal in number to the plurality of openings in the periphery and protruding through the plurality of openings to be visible externally of the shoe;

iii. a sound generator comprising:

a. an integrated circuit; and b. a speaker electrically connected to the integrated circuit; and iv. means, visible at said aperture and adapted to move between an open position and a closed position responsive to movement of the shoe, for selectively electrically connecting the battery to the plurality of light sources and the sound generator, which means comprises:

a. an enclosure having a window positioned at said aperture;

b. an electrically-conductive base within the enclosure;

c. a plurality of spaced resilient metal strips at least one greater in number than the plurality of light sources, each strip electrically connected to one of the plurality of light sources and to the sound generator and each of said plurality of spaced resilient metal strips disposed in said open position, spaced from contact with the base;

d. a ball visible external of the shoe through the window disposed at said aperture and positioned to roll within the enclosure along the base and over the strips responsive to movement of the shoe, so as momentarily to depress the strips from said open position toward said closed position, into contact with the base as it rolls over them, thereby momentarily electrically connecting the battery to the plurality of light sources and sound generator.

* * * * *

UNITED STATES PATENT AND TRADEMARK OFFICE

CERTIFICATE OF CORRECTION

PATENT NO. : 5,483,759

DATED : January 16, 1996

INVENTOR(S) : Jeffrey N. Silverman

It is certified that error appears in the above-identified patent and that said Letters Patent is hereby corrected as shown below: On the title page: Item [56]

References Cited, FOREIGN PATENT DOCUMENTS, "26088485" should be --2608485--.

Cover page, at Attorney, Agent, or Firm, "Fish & Richardson" should be --Fish & Richardson P.C.--.

Col. 6, line 6, "Contacts" should be --contacts--.

Signed and Sealed this

Twelfth Day of November, 1996

*Attest:*

Bruce Lehman

BRUCE LEHMAN

*Attesting Officer*

*Commissioner of Patents and Trademarks*